US008961052B1

(12) United States Patent
Schumaier

(10) Patent No.: US 8,961,052 B1
(45) Date of Patent: Feb. 24, 2015

(54) GOLF TEE INSERTION DEPTH MEASUREMENT AND MARKING SYSTEM

(71) Applicant: TeeCorrect, LLC, Johnson City, TN (US)

(72) Inventor: Daniel R Schumaier, Elizabethton, TN (US)

(73) Assignee: TeeCorrect, LLC, Johnson City, TN (US)

( * ) Notice: Subject to any disclaimer, the term of this patent is extended or adjusted under 35 U.S.C. 154(b) by 0 days.

(21) Appl. No.: 14/453,002

(22) Filed: Aug. 6, 2014

Related U.S. Application Data

(63) Continuation-in-part of application No. 14/246,326, filed on Apr. 7, 2014, and a continuation-in-part of application No. 14/171,032, filed on Feb. 3, 2014, now Pat. No. 8,864,400, which is a continuation-in-part of application No. 14/035,523, filed on Sep. 24, 2013, now Pat. No. 8,790,034.

(51) Int. Cl.
*B43K 29/00* (2006.01)

(52) U.S. Cl.
USPC ..... 401/195; 401/266; 473/386

(58) Field of Classification Search
USPC ..... 401/266; 33/485, 666; 473/386, 387
See application file for complete search history.

(56) References Cited

U.S. PATENT DOCUMENTS

| | | | | |
|---|---|---|---|---|
| 5,885,174 | A * | 3/1999 | Barnes | 473/386 |
| 6,482,111 | B1 * | 11/2002 | Jofferion | 473/386 |
| 7,458,906 | B2 * | 12/2008 | Choe | 473/387 |
| 2004/0266584 | A1 * | 12/2004 | Janson et al. | 477/79 |

* cited by examiner

*Primary Examiner* — David Walczak
*Assistant Examiner* — Jennifer C Chiang
(74) *Attorney, Agent, or Firm* — Luedeka Neely Group, P.C.

(57) ABSTRACT

A golf tee insertion depth marking system includes a measurement tool and a marking tool. The marking tool includes a housing having first and second surfaces. Bores extend into the housing from the first surface. Windows are disposed in the second surface of the housing that provide openings into the bores at various distances from the first surface. Each of the windows is of sufficient size to receive the tip of a marking pen to mark the shaft of a golf tee inserted into the bore. The measurement tool includes a base portion and a stem portion. The stem portion extends upwardly from the base portion and has spaced-apart apertures extending there through. The apertures are used to measure the height of the striking face of a golf club, which height is used to determine which window in the marking tool to use to mark the golf tee.

25 Claims, 16 Drawing Sheets

GOLF TEE INSERTION DEPTH MEASUREMENT AND MARKING SYSTEM

RELATED APPLICATIONS

This application claims priority as a continuation-in-part of U.S. patent application Ser. No. 14/171,032, filed Feb. 3, 2014, titled "Golf Tee Insertion Depth Marker," which issued as U.S. Pat. No. 8,864,400 and is a continuation-in-part of U.S. patent application Ser. No. 14/035,523, filed Sep. 24, 2013, titled "Golf Tee Insertion Depth Marker." This application also claims priority as a continuation-in-part of U.S. patent application Ser. No. 14/246,326, filed Apr. 7, 2014, titled "Golf Tee Insertion Depth Measurement Tool." The entire contents of the priority applications are incorporated herein by reference.

FIELD

This invention relates to gauges for golf tees and, in particular, to a golf tee insertion depth marker tool that marks the shaft of a golf tee at a certain height to assist in ensuring that the golf tee is inserted into the ground at the desired depth consistently. This invention also relates to a golf tee insertion depth measurement tool that provides measuring an optimum insertion depth for a golf tee.

BACKGROUND

In the game of golf, a player may strike a golf ball while it lies directly on the ground surface or from a tee that has been placed into the ground. Golfers may prefer to hit the ball from a tee instead of the ground for various reasons. One reason is that the ground surface may not be suitable for hitting the ball (e.g., frozen ground). Another reason is that it places the ball more easily into the path of the golf club's head. For example, drivers have heads that are larger than most other golf clubs and are often used for the first or "tee" shot. A player will often use a golf tee to ensure that the golf ball is placed in the club's swing path thereby ensuring that the club strikes the ball squarely in order to optimize distance and trajectory of the ball.

When using a tee, a player manually pushes the shaft of the tee into the ground to a certain depth to place the top of the golf tee at a certain height above the ground surface. Varying this insertion depth varies the height at which the ball sits above the ground surface. Different clubs may require different ball heights in order to optimize the ball's distance and trajectory once it is hit. For example, for a large driver, the ball would likely be positioned higher (i.e., further from the ground), while use of a smaller club may require a ball to be positioned lower (i.e., closer to the ground).

Another reason for varying the tee height is that different golfers may have different preferences that are unique to them and may depend on a number of factors, such as their height, swing pattern, whether they want to hit a hook or slice shot, etc.

Once the golfer has determined a suitable tee height and club combination, the golfer endeavors to maintain that same combination from one shot to the next to ensure that the ball is hit consistently. Golfers who can minimize the number of variables in their game that may contribute to errors are often the most successful. Therefore, in addition to developing a consistent swing pattern, another important factor for having a successful golf game is to maintain a consistent tee height. In doing so, it is often beneficial to have some visual marking present on the golf tee itself to indicate how far the tee should be inserted into the ground. Finally, as mentioned before, the desired tee height may vary depending on the type and size of club used. Therefore, it is also preferable to have a way to easily mark the tee at different locations along the length of the shaft of the tee in order to provide for different tee heights.

In general, a golf tee is preferably set at a height such that the horizontal center of the golf ball is located approximately at the same height as the upper edge of the striking face of the club when the club is resting on the ground. Different clubs are sized differently and so the golf tee and ball must be raised or lowered accordingly. Additionally, maintaining a constant golf ball height from one hole to the next is an important factor in maintaining a consistent swing path.

What is needed, therefore, is a golf tee insertion depth marker tool that provides a visual depth marking on the tee itself and at adjustable heights to assist the golfer in maintaining a consistent tee height from one shot to the next.

What is also needed is a golf tee insertion depth measurement tool that facilitates the process of quickly and consistently identifying an appropriate insertion depth wherein the horizontal center of the golf ball is located approximately at the same height as the upper edge of the striking face of the club to assist the golfer in maintaining a consistent tee height from one shot to the next.

SUMMARY

The above and other needs are met by a golf tee insertion depth marking system that is used to mark a shaft of a golf tee to indicate a desired insertion depth. Preferred embodiments of the system include a measurement tool and a marking tool.

A preferred embodiment of the marking tool includes a housing having at least a first surface and a second surface. A first bore and a second bore extend into the housing from the first surface. Both bores have a diameter sufficient to receive the shaft of the golf tee when the shaft is inserted therein. A plurality of first windows and a plurality of second windows are disposed in the second surface of the housing. The first windows provide openings into the first bore at various distances from the first surface, and the second windows provide openings into the second bore at various distances from the first surface. Each of the first and second windows is of sufficient size to receive a tip portion of a marking pen inserted therein, so that the tip portion of the marking pen may make contact with and mark the shaft of the golf tee inserted into the first bore or the second bore.

A preferred embodiment of the measurement tool includes a base portion and an elongate stem portion. The base portion has an upper edge and a bottom surface that is spaced from the upper edge by a distance D. The elongate stem portion is connected to the base portion and extends upwardly from the base portion to a height $H_2$ above the upper edge of the base portion. The stem portion has a plurality of spaced-apart apertures extending there through.

In yet another aspect, a method is described for using the measurement tool in conjunction with the marking tool to mark the shaft of a golf tee to indicate a desired insertion depth that will provide an optimum height above the ground for a golf ball placed on the golf tee, which ball is to be struck by a golf club head having a face. In one embodiment, the method includes the steps of:

(a) placing the base portion of the measurement tool on the ground with the stem portion extending upwardly;

(b) placing the golf club head on the ground with the face of the golf club adjacent the measurement tool;

(c) determining which one of the apertures in the stem portion of the measurement tool is closest to an upper edge of the face of the golf club;

(d) placing the measurement tool adjacent the marking tool, with the apertures of the measurement tool aligned with the windows of the marking tool;

(e) determining which one of the windows of the marking tool is aligned with the aperture determined in step (c);

(f) inserting the golf tee into the bore of the marking tool; and (g) marking the shaft of the golf tee by inserting a tip portion of a marking pen into the window determined in step (e) and contacting the tip portion of the marking pen against the shaft of the golf tee.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
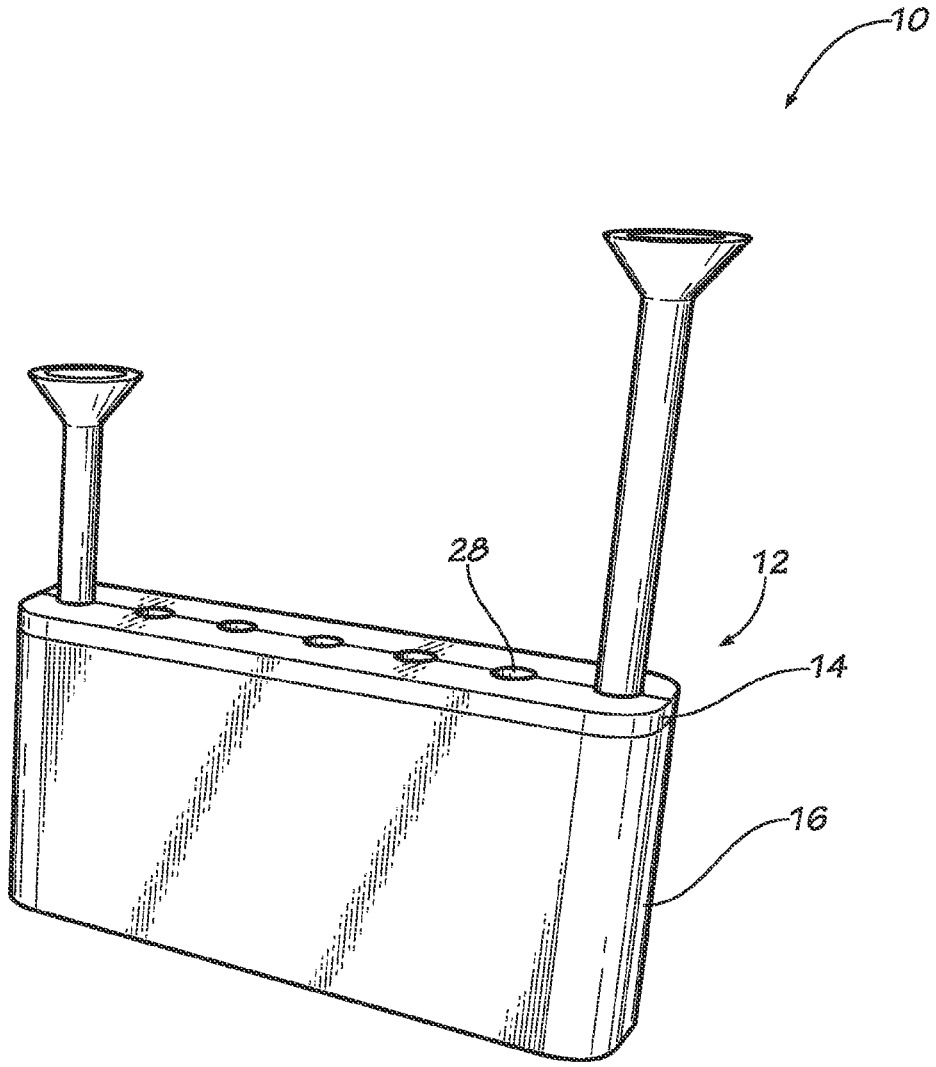
FIG. 1 depicts a golf tee insertion depth marker tool according to a first embodiment of the invention with tees inserted into two of the marking wells.
Figure 2:
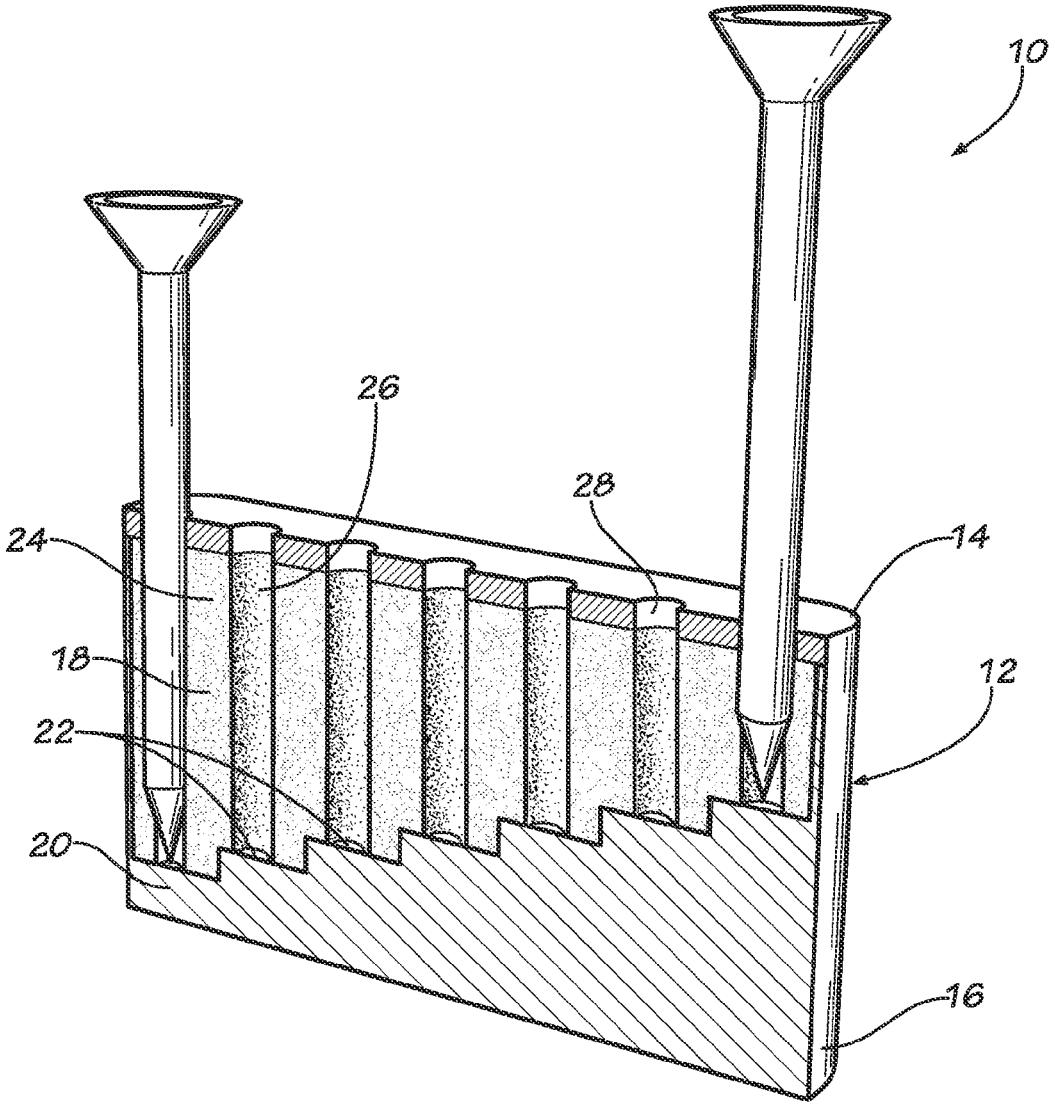
FIG. 2 depicts a cutaway view of the golf tee insertion depth marker tool shown in FIG. 1.
Figure 4:
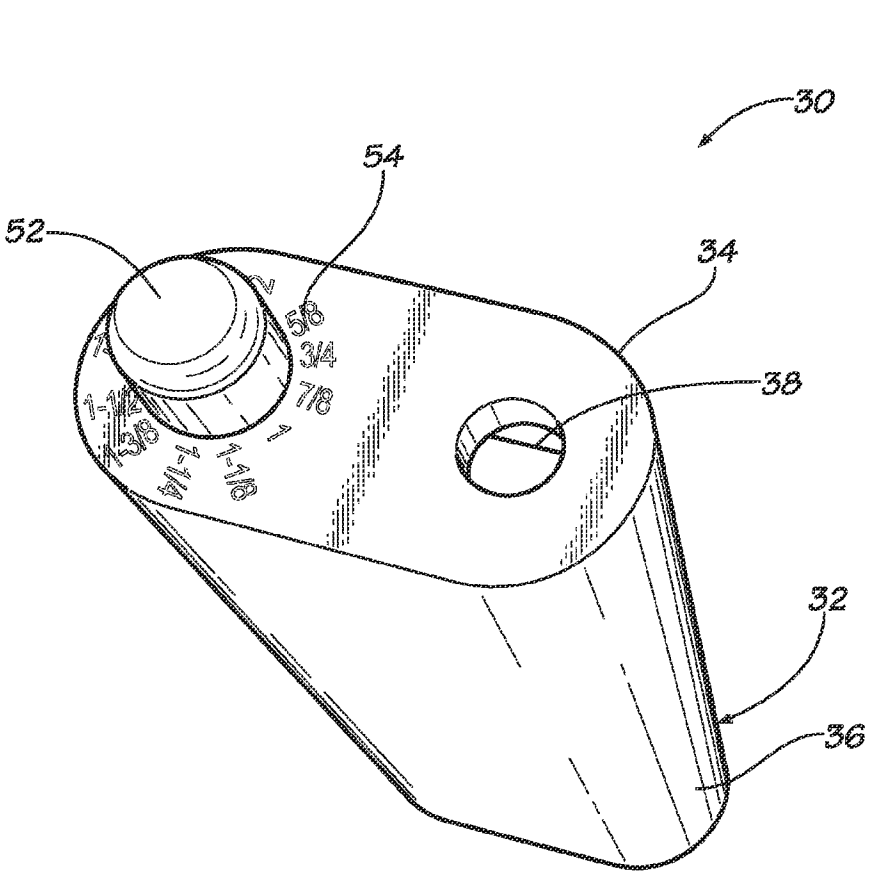
FIG. 4 is a top perspective view depicting a golf tee insertion depth marker tool according to a second embodiment of the invention having a single opening and a height adjustment screw and gauge.
Figure 3:
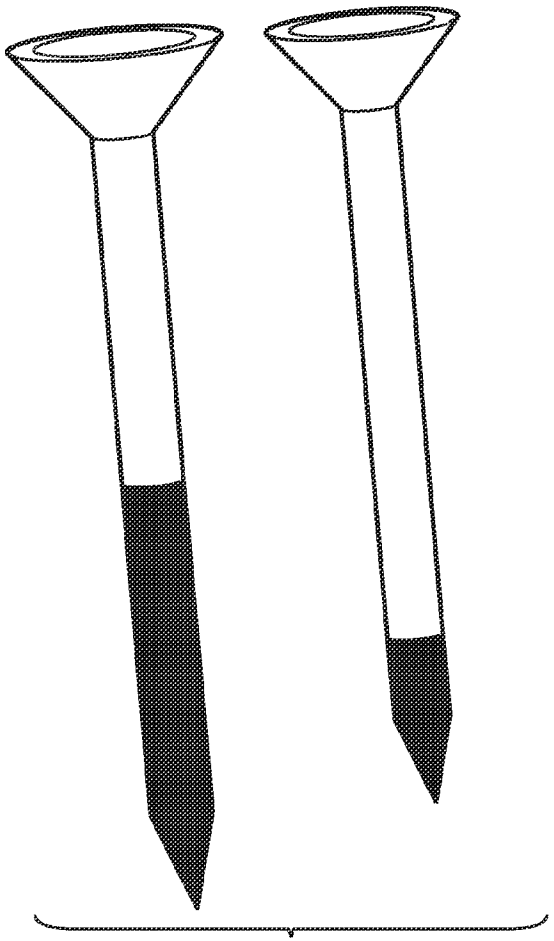
FIG. 3 depicts two tees after being removed from the golf tee insertion depth marker tool and demonstrating markings at two different heights.
Figure 5:
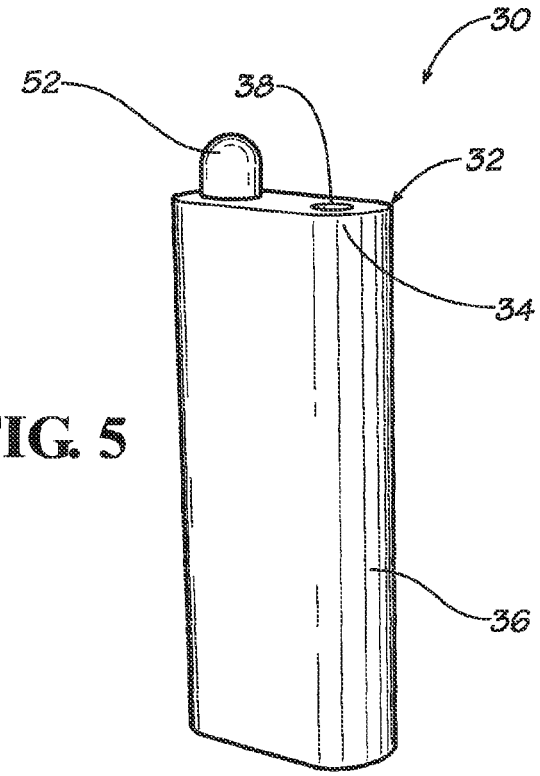
FIG. 5 is a front perspective view of the golf tee insertion depth marker tool shown in FIG. 4.

Turning now to the drawings in greater detail and considering first FIGS. 1-3, there is illustrated an embodiment, generally indicated 10, of a golf tee insertion depth marker tool within which features of the present invention are embodied. The marker tool 10 is in the form of a handheld device for marking golf tees that may be placed conveniently into a golf bag, for example, for easy access and use. In general, as further described below, golf tees may be inserted one of a series of wells formed into the device and a marking fluid inside of the device marks the tee. The height of that marking is determined by how far the tee is inserted into the device. Each well has a different depth such that tees may be marked at different heights by placing them into the different wells.

As shown in FIGS. 1 and 2, a preferred embodiment of the marker tool 10 includes an elongate generally rectangular housing 12 that is made from two pieces, an upper cover portion 14 and a reservoir portion 16 that holds the marking fluid. The reservoir portion 16 of the depicted marker 10 is preferably a one-piece component comprising a fluid container portion 18 having a hollow center area and a bottom portion 20 that are integrally joined together. However, the reservoir 16 can be constructed as a multi-component item. In a preferred embodiment, the upper cover portion 14 and the reservoir portion 16 are made of thermoplastic and are formed by injection molding or 3D printing.

The bottom 20 includes a series of ledges 22 that are formed in stair step fashion such that adjacent ledges are at different heights from one another. When a tee is inserted into the marking device 10, the height of the ledges 22 determines how far the tee may be inserted, which, in turn, determines the height at which the tee is marked. The difference in height of the ledges 22 may vary from one step to the next, or they may be uniformly spaced. For example, each ledge 22 may be $1/4^{th}$ of an inch higher or lower than the adjacent ledge. Alternatively, the height of two ledges 22 may be $1/8^{th}$ of an inch apart while the height of two other ledges may be ½ of an inch apart.

The upper cover portion 14 of the depicted marker tool 10 extends across the top of the marker tool and covers the open top of the reservoir portion 16. The cover 14 portion and the reservoir portion 16 may be permanently sealed together, such as by sonic welding or with an adhesive. Alternatively, they may be press-fit together so that the two portions may be separated from one another. Preferably, the two portions 14 and 16 are separable from one another to provide access to the fluid container portion 18 of the reservoir 16. Such access may be beneficial for refilling the marker tool 10 with marking fluid or for removing debris that may become trapped within the marker tool.

The cover portion 14 includes a plurality of openings 28, sized to permit a golf tee to be accepted into them, that are formed along the length of the cover portion 14 at distances that correspond with the ledges 22 of the bottom 20 such that each opening 28 aligns with a corresponding ledge 22 when the cover portion 14 and the reservoir portion 16 are joined together. For this and other embodiments described herein that incorporate marking fluid, plugs may be provided to seal the openings 28 when the marker tool is not in use to slow evaporation of the marking fluid or prevent spilling of the marking fluid.

As shown in FIG. 2, the marking device 10 also includes a sponge 24, which is of a type similar to sponges for stamps, that is infused with a marking fluid for marking the tees. The marking fluid may include pigments, inks, dyes, etc. The shape of the sponge 24 preferably mimics the shape of the interior of the marker tool 10, including having a bottom surface that includes stair step ledges, such that the sponge rests on the ledges 22 of the bottom 20 of the marker tool. Alternatively, the sponge 24 extends downward only partially into the fluid container portion 18 and is flat along its bottom surface. The sponge 24 further includes a series of passageways, bores or wells 26 disposed along its length that align with the openings 28 and are correspondingly spaced apart with the ledges 22 such that a well corresponds with each of the ledges.

The wells 26 are sized and configured to accept a golf tee when it is inserted into the marker tool 10 through one of the openings 28. As may be appreciated, upon inserting a tee into the marker tool 10, a portion of the marking fluid is transferred to the outer surface of the tee, thereby marking the tee. Accordingly, to ensure that the marking fluid is transferred effectively, the dimensions of the opening 28 and well 26 should be substantially the same as the dimensions of the shaft portion of the tee.

FIG. 3 depicts an example of tees marked at two different heights. Inserting the tee into an opening 28 that is paired with a well 26 having a greater depth causes the golf tee to be marked higher up on the shaft of the tee, which thereby indicates that the tee should be inserted further into the ground. Conversely, a more shallow well marks the tee at a lower height, which indicates that the tee should be inserted at a more shallow depth into the ground such that the ball rests higher above the ground.

It will be understood that numerous modifications and substitutions can be made to the first embodiment of a marker tool 10 described above without departing form the spirit of the invention. For example, although the embodiment 10 includes several openings 28, wells 26, and ledges 22 that are formed along the length of an elongate housing 12, the length of the housing may be significantly shorter and include a single opening, well and ledge. For example, FIGS. 4-7 illustrate an alternative embodiment of a golf tee insertion depth marker tool 30 having a housing 32 that is made from two pieces: an upper cover portion 34 and a reservoir portion 36 that holds the marking fluid. As in other embodiments, a sponge impregnated with a marking fluid is disposed in the reservoir portion 36 of the housing 32. As the tee is inserted into the marker tool 30, marking fluid is transferred from the sponge to the tee in order to mark the tee.

Figure 6:
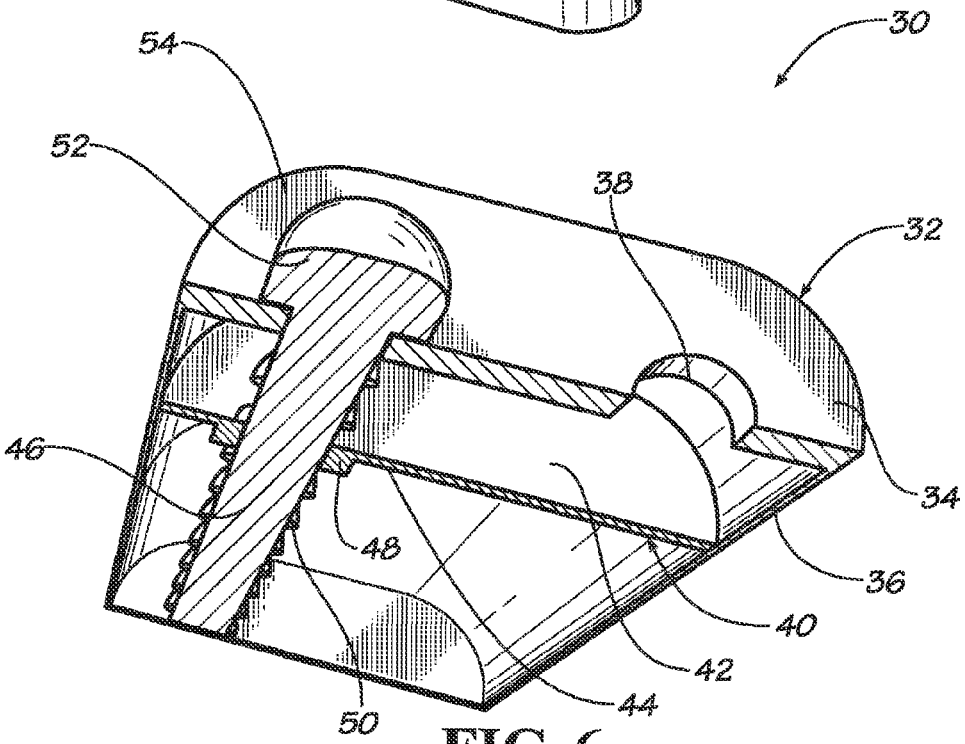
FIG. 6 is a top perspective cutaway view of the golf tee insertion depth marker tool of FIG. 4.
Figure 7:
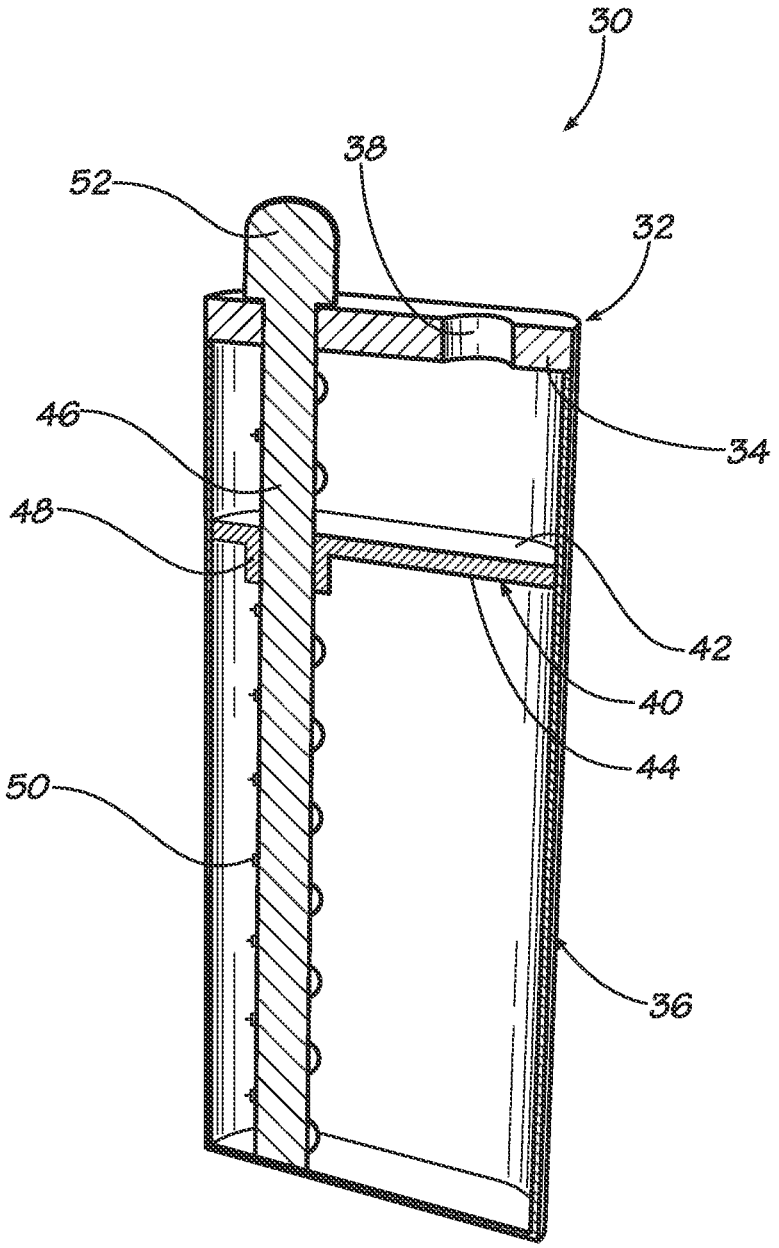
FIG. 7 is a front perspective cutaway view of the golf tee insertion depth marker tool of FIG. 4.

The marker tool 30 preferably includes a single opening 38 through which a tee may be inserted into the marker tool. As shown in FIG. 6, a depth platform 40 is disposed within the reservoir portion 36 of the housing for determining how far a tee may be inserted into the reservoir portion 36. The depth platform 40 is preferably a flat platform having a first surface 42 and a second surface 44 and an aperture formed through it. The platform 40 is sized to fit within and travel along the inside of the walls of the reservoir portion 36 of the marker tool 30. Moving the platform 40 upwards causes the distance between the first surface 42 of the platform and the opening 38 to be reduced, which causes the height of the marking on the tee to be lowered. Conversely, moving the platform 40 downward causes the distance between the first surface 42 of the platform and the opening 38 to be increased, which causes the height of the marking on the tee to be higher.

This adjustment may be made using an adjustment screw 46, which is located within the reservoir portion and extends through the aperture in the depth platform 40. A lip 48, surrounds the aperture on the second surface 44 of the platform 40, rests on threads 50 of the screw 46. As the screw 46 is turned, the lip 48 travels along the threads 50 of the screw thereby causing the platform 40 to be raised or lowered, depending on the direction that the screw is turned. As shown best in FIG. 4, the screw 46 is turned using the external depth dial 52. Preferably, indicia 54 are provided on or near the depth dial 52 to indicate the depth to which a tee may be inserted into the platform 40. To mark a golf tee using the marker tool 30, the desired depth of insertion is first selected using the depth dial 52. The golf tee is then inserted into the opening 38 until the tip of the tee comes into contact with the platform. To mark a tee at a different depth, the depth dial is then adjusted and the process of marking is repeated. The indicia may be provided in various increments, such as $\frac{1}{4}^{th}$ or $\frac{1}{8}^{th}$ of an inch. This will enable a user to quickly and easily select a preferred depth by simply turning to the desired depth. However, one notable advantage of this design is that a user may optionally select a depth that is between the indicia markings 54. For example, a user might prefer a depth that is between $\frac{7}{8}^{th}$ of an inch and one inch. In that instance, the dial 52 could be turned to a desired position between these two indicia 54, thereby providing an infinite number of marking possibilities.

Figure 13:
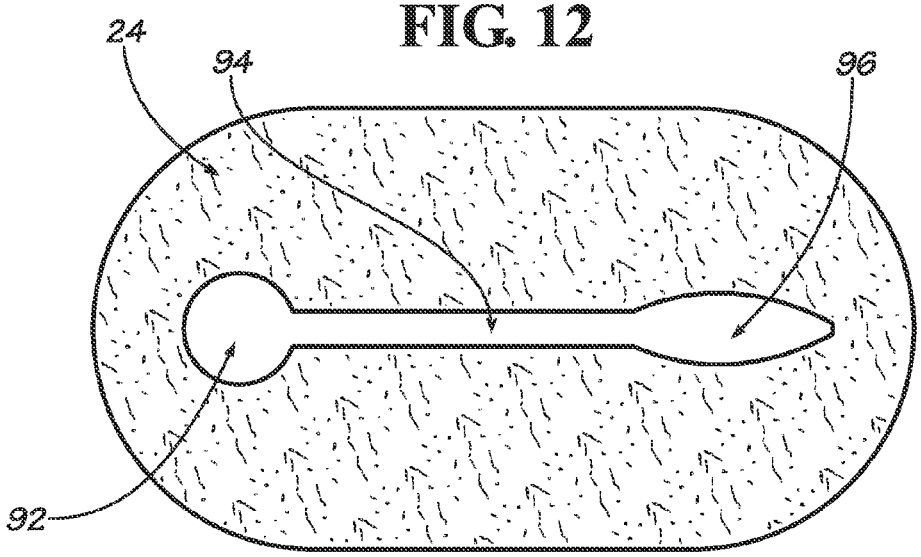
FIG. 13 is a cross section view of an ink sponge of a golf tee insertion depth marker tool according to the embodiment of FIG. 4.

The size, configuration and location of the sponge in the embodiment of FIGS. 4-7 may vary. In one preferred embodiment depicted in cross-section in FIG. 13, the sponge 24 is sized so that it fills substantially the entire reservoir area 36. In that instance, the sponge may be provided with a slot 94 that enables the platform 40 to travel within the reservoir area 36. Slots 92 and 96 are provided in the sponge 24 to accommodate the screw 46 and receive the tee. In some embodiments, the sponge 24 is sized such that it occupies only a portion of the reservoir area 36. Preferably, the sponge is positioned within the reservoir area 36 immediately adjacent to and extending a short distance away from the upper cover portion 34, such that the sponge is located between the platform 40 and the upper cover portion. In this configuration, the slot 94 is not necessary since the platform 40 does not travel through the sponge 24.

Figure 9:
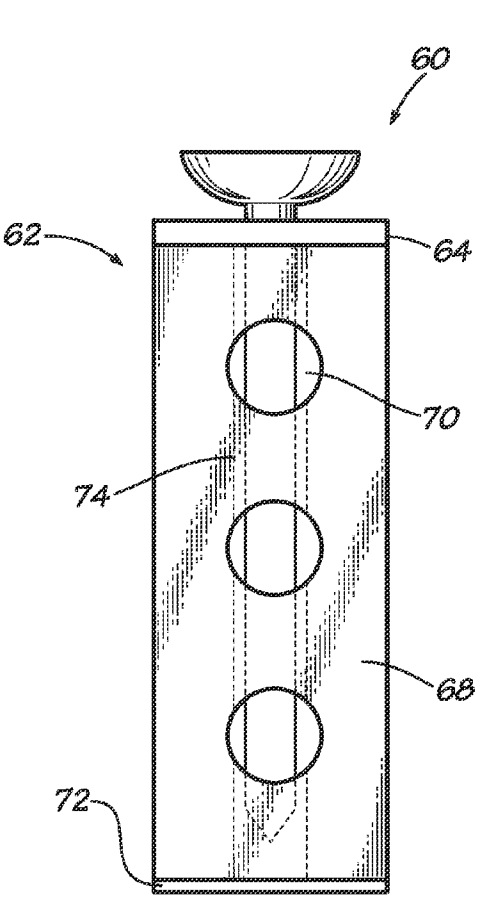
FIG. 9 is a front elevation view depicting the golf tee insertion depth marker tool of FIG. 8.
Figure 8:
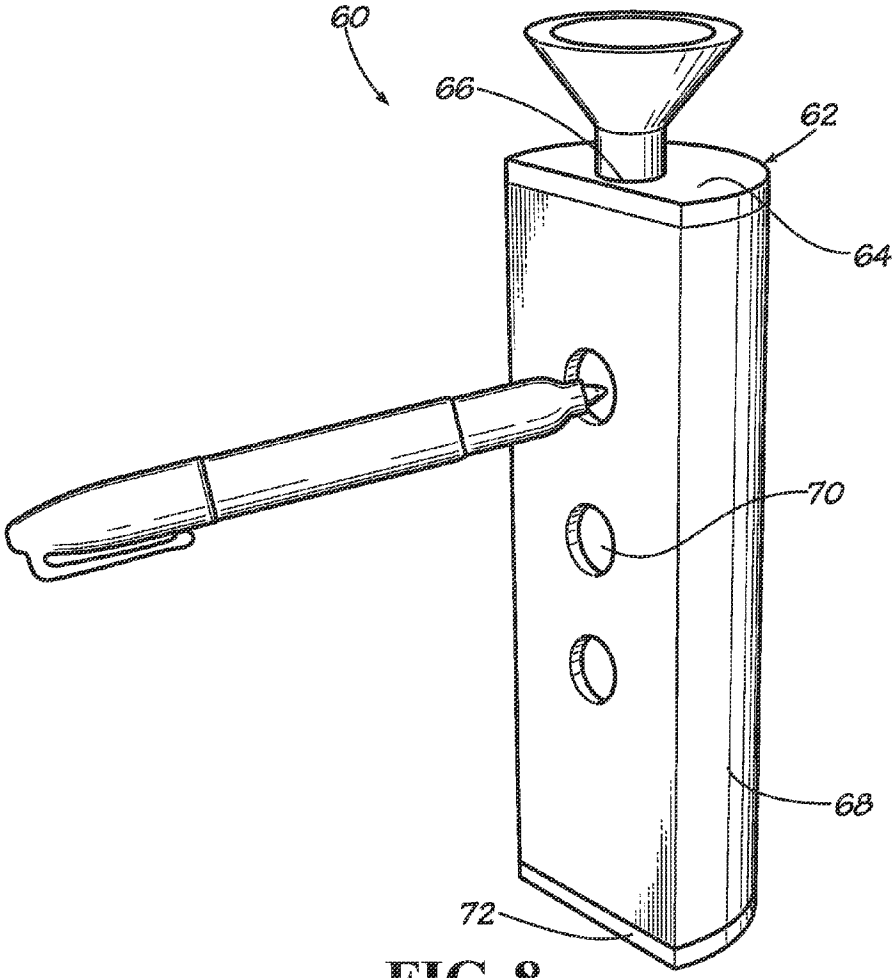
FIG. 8 is a perspective view depicting a golf tee insertion depth marker tool according to a third embodiment having a single opening and a plurality of marking windows.
Figure 10:
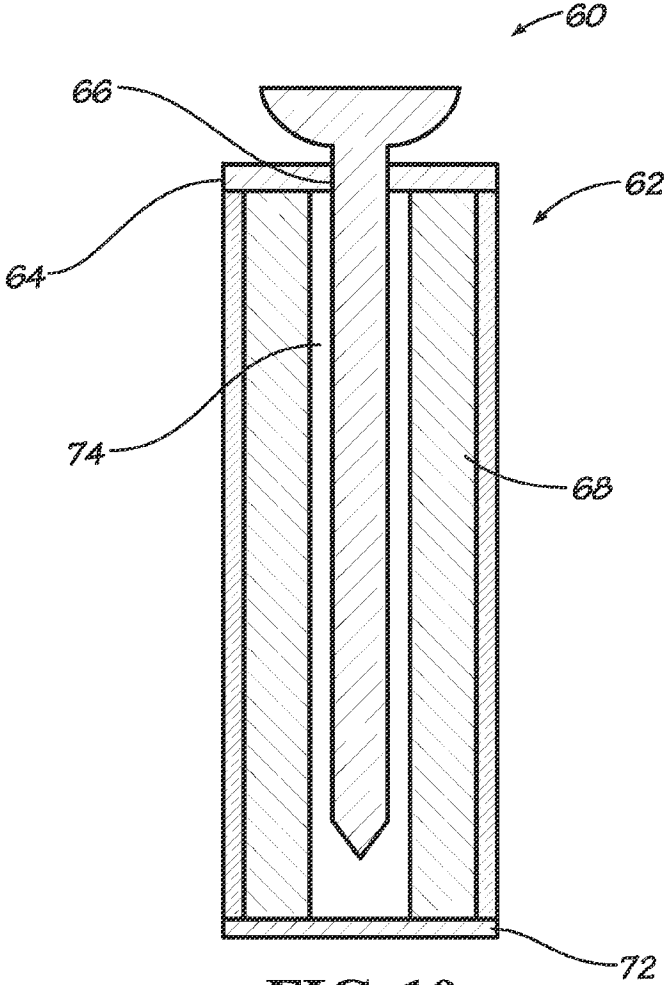
FIG. 10 is a front cutaway view depicting the golf tee insertion depth marker tool of FIG. 8.

With reference now to FIGS. 8-10, a golf tee insertion depth marker tool 60 according to a third embodiment is depicted. Unlike the aforementioned embodiments 10 and 30, this embodiment 60 does not require a tee to be inserted into a reservoir of marking fluid. Rather, an external marking device, such as a permanent marker or ink pen, may be used to mark the tee.

The marker tool 60 comprises a housing 62 that includes an upper cover portion 64, including an opening 66 to allow for a tee to be inserted into the housing, an elongate lower marking portion 68, including a plurality of windows 70 formed along the side of the housing, a bottom portion 72, and a central channel 74 for receiving the shaft of a golf tee. The cover portion 64, lower marking portion 68, and bottom portion 72 of the depicted marker tool 60 preferably form a one-piece component that is integrally joined together. However, the marker tool 60 can be constructed as a multi-component item. In a preferred embodiment, the upper cover portion 64, the lower marking portion 68 and bottom 72 are made of thermoplastic and are formed by injection molding or 3D printing.

This marker tool 60 permits a user to mark the entire perimeter of the tee quickly and easily at various heights along the shaft of the golf tee. The first step is to insert the shaft of the tee into the marking device through the opening 66 and into the channel 74. The opening 66 and channel 74 are preferably large enough to permit the tee to easily turn within the opening. However, these features are preferably small enough that the movement of the tee is limited to prevent skewed marking caused by excessive movement. As depicted in the drawings, the tee may be inserted until the bottom surface of the head of the tee contacts the upper surface of the cover portion 64 at the opening 66.

As shown best in FIGS. 8 and 9, once the tee has been inserted, portions of the shaft of the tee are visible through the windows 70 disposed at various heights along the side of the marker tool 60. The windows 70 shown in the figures are exaggerated in size for illustration purposes only. The windows 70 are preferably sized and configured so as to receive and securely hold the tip of a marking device, such as an ink marker, pencil or pen, such that it contacts the exterior surface of the tee. The windows 70 may be positioned at various locations along the housing 62 in order to mark the tee at various heights. For example, each window 70 may be $\frac{1}{4}^{th}$ of an inch higher or lower than the adjacent window. Alternatively, the distances between two windows 70 may vary. Although the figures show windows 70 only on one side of the marker tool 60 and axially aligned with the channel 74, windows may be located and spaced about the entire housing in order to provide a larger choice of marking heights. Once the tee and marker pen have been correctly positioned, the tee is then turned within the housing 62 in order to mark the perimeter of the tee.

Figure 11:
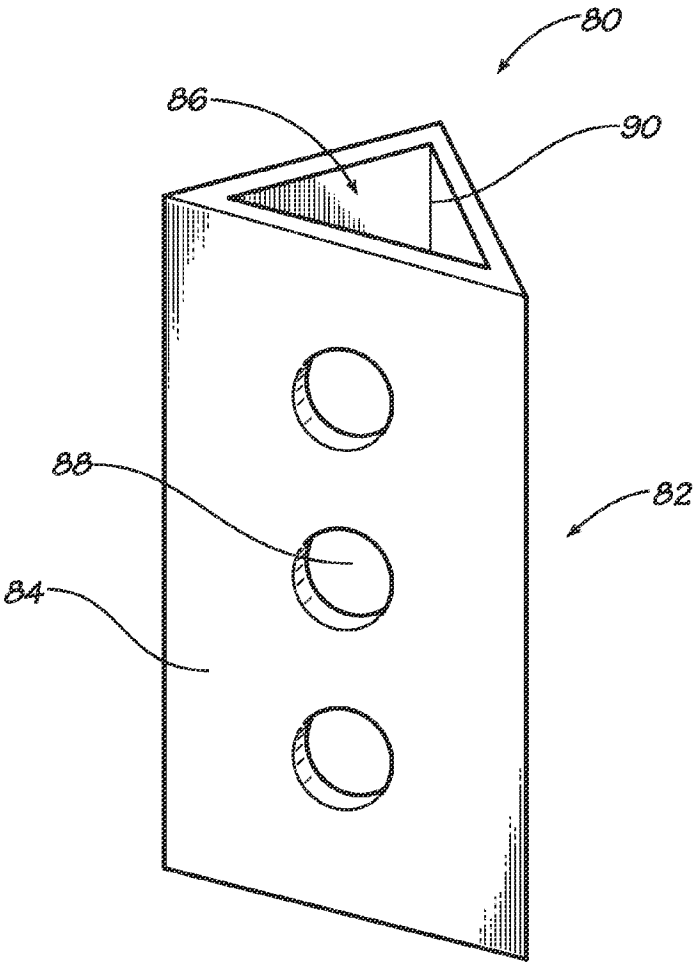
FIG. 11 is a perspective view depicting a golf tee insertion depth marker tool according to a fourth embodiment.

In a fourth embodiment depicted in FIG. 11, the marker tool 80 includes a housing 82 having sides 84 and an open top 86 that is sized to receive the shaft of a golf tee. Preferably, the open top 86 is only slightly larger than the golf tee, while at the same time being large enough to permit the tee to be easily turned within the opening.

One or more of the sides 84 also include a plurality of windows 88. As before, portions of the shaft of a tee inserted into the marker tool 80 would be visible through windows 88, which are positioned at various heights along the side(s) 84 of the marker tool. Although pictured on only one side 84 of the marker tool 80, windows 88 may be placed on multiple sides of the marker device. These windows 88 accommodate the tip of a marking device in a manner similar to the windows discussed above.

Figure 12:
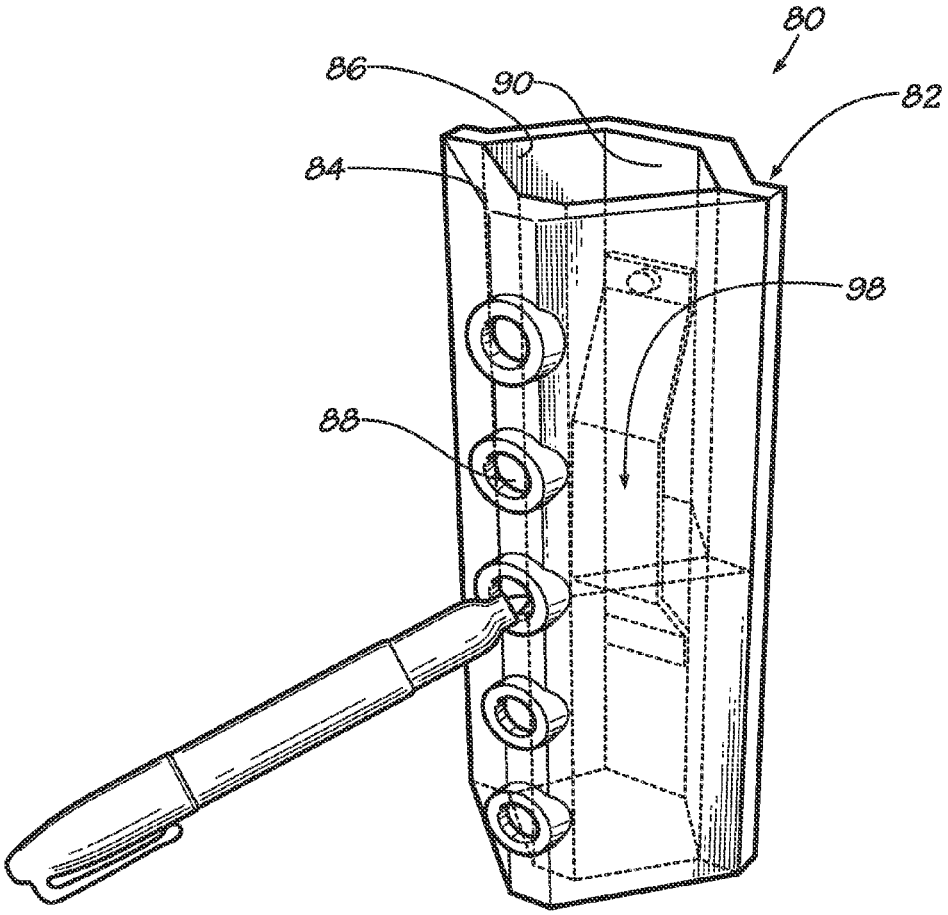
FIG. 12 is a perspective view depicting a golf tee insertion depth marker tool according to a fifth embodiment.

After inserting the tee into the open top 86, a marking device is then inserted into a window 88 at the desired height. The tip of the marking device presses against the shaft of the tee, thereby urging the tee against a corner 90 where two sides of the housing meet and stabilizing the tee as it is turned and marked with the marking device. As previously mentioned, windows 88 may be placed on multiple sides of the housing so that a variety of marking heights are available. Accordingly, the housing 82 of the marker tool 80 is preferably triangular in cross section as shown in FIG. 11, so that it would function in the same manner from all sides. However, the marker tool 80 may be formed in shapes other than triangular, such as shown in the embodiment of FIG. 12 which includes a leaf spring 98 that urges the shaft of the tee against the inside of the front side 84 of the housing 82 in which the windows 88 are disposed.

Figure 14A:
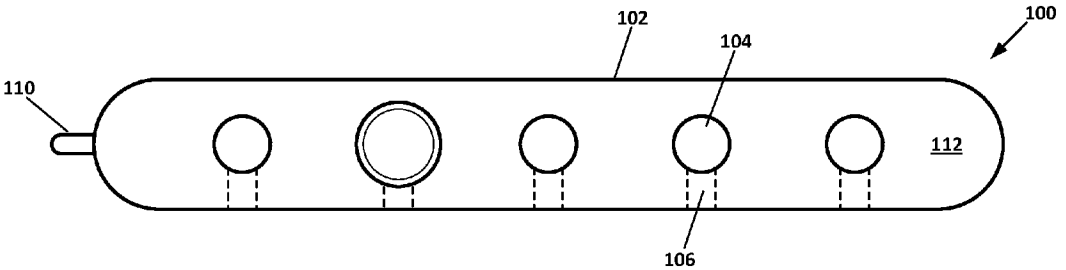
FIGS. 14A, 14B and 14C depict a golf tee insertion depth marker tool according to a sixth embodiment.
Figure 14C:
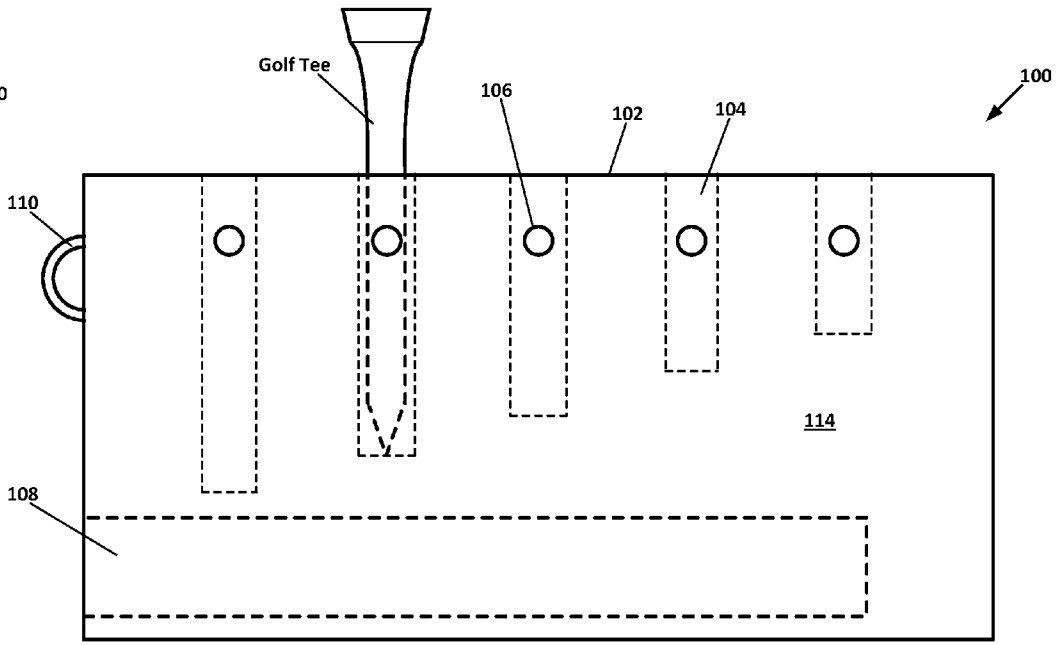
Figure 14B:
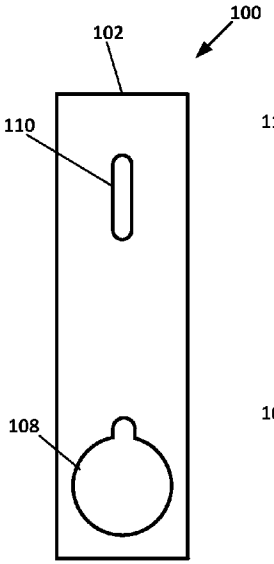
Figures 15A, 15B, 15C, 15D, 15E:
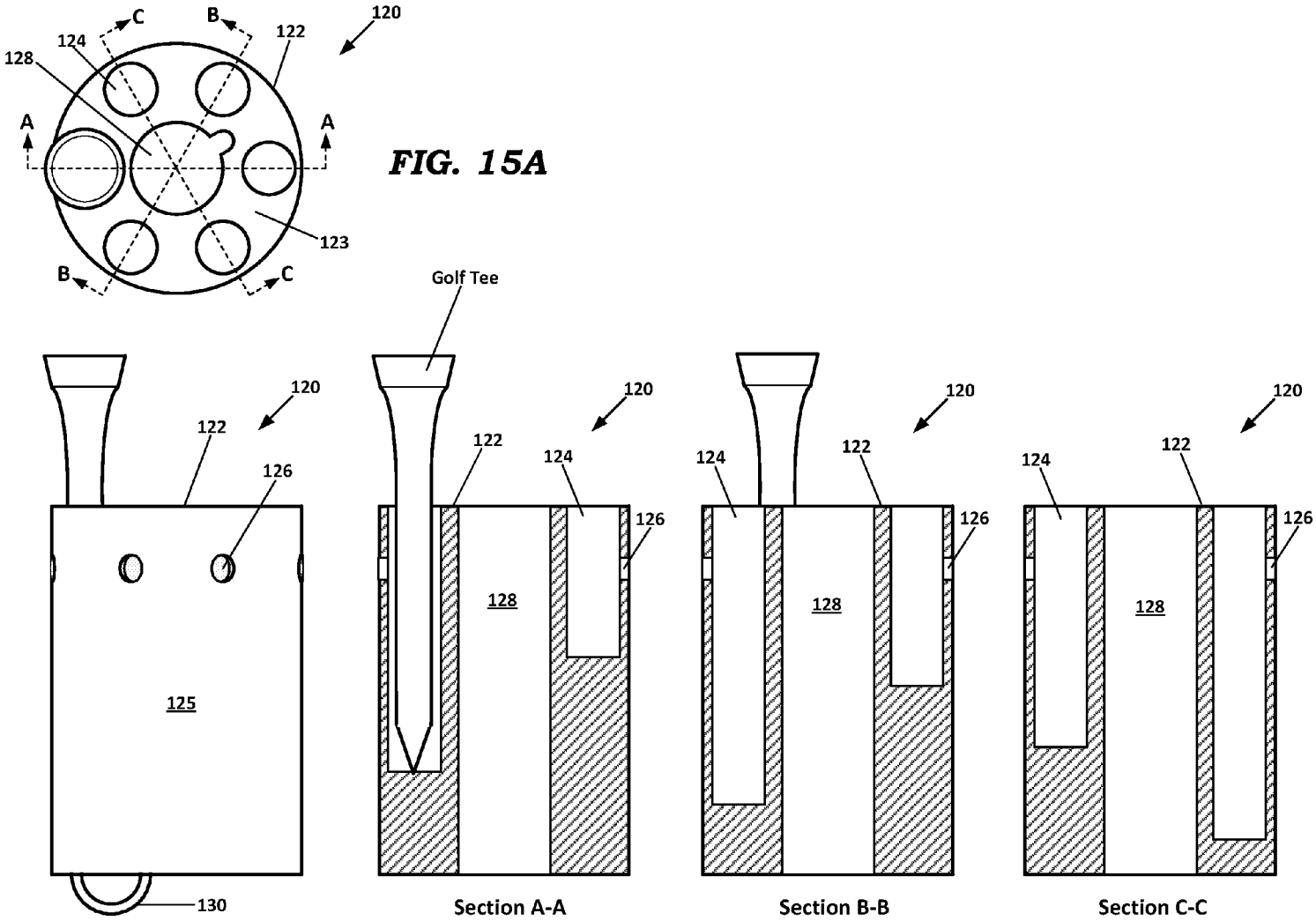
FIGS. 15A, 15B, 15C, 15D and 15E depict a golf tee insertion depth marker tool according to a seventh embodiment.

FIGS. 14A, 14B and 14C depict a sixth embodiment of a golf tee insertion depth marker tool 100. The marker tool 100 includes a housing 102 containing a linearly-aligned, side-by-side series of bores 104. Each bore 104 has a diameter sufficient to receive the shaft of a golf tee and extends from a planar upper surface 112 into the housing to a depth related to a desired insertion depth of the tee. Windows 106 are provided in a planar side surface 114 of the housing 102, each aligned with a corresponding one of the bores 104. After fully inserting the tee into a bore 104, the tip of a marking pen may be inserted into the corresponding window 106 to mark the tee.

In the sixth embodiment, the upper surface 112 of the housing is also referred to herein as a first surface, and the side surface 114 of the housing, also referred to herein as a second surface, is substantially perpendicular to the upper surface 112. The bores 104 of this embodiment are substantially parallel to the side surface 114.

This sixth embodiment includes a loop 110 by which the marker tool 100 may be clipped or tied to a golf bag or other structure for safekeeping. This embodiment also includes a recess 108 for receiving and storing the marking pen when it is not in use.

FIGS. 15A-15E depict a seventh embodiment of a golf tee insertion depth marker tool 120. The marker tool 120 includes a housing 122 containing concentrically aligned, side-by-side bores 124. Each bore 124 has a diameter sufficient to receive the shaft of a golf tee and extends from a planar upper surface 123 into the housing to a depth related to a desired insertion depth of the tee. Windows 126 are provided in a cylindrical side surface 125 of the housing 122, each aligned with a corresponding one of the bores 124. After fully inserting the tee into a bore 124, the tip of a marking pen may be inserted into the corresponding window 126 to mark the tee.

In the seventh embodiment, the upper surface 123 of the housing is also referred to herein as a first surface, and the side surface 125 of the housing, also referred to herein as a second surface, is substantially perpendicular to the upper surface 123. The bores 124 of this embodiment are substantially parallel to the side surface 125.

This seventh embodiment also includes a loop 130 by which the marker tool 120 may be clipped or tied to a golf bag or other structure for safekeeping. This embodiment also includes a recess 128 for receiving and storing the marking pen when it is not in use.

Figure 16B:
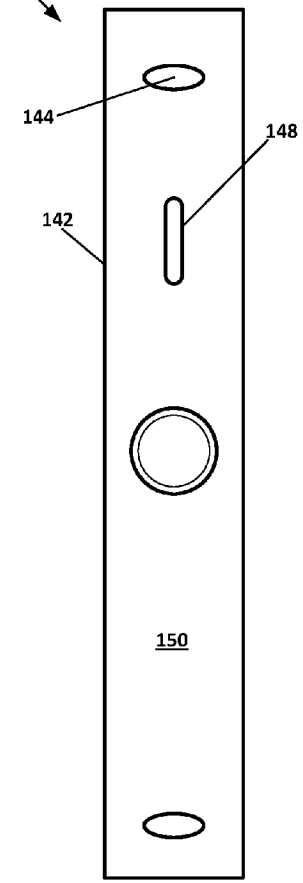
FIGS. 16A and 16B depict a golf tee insertion depth marker tool according to an eighth embodiment.
Figure 16A:
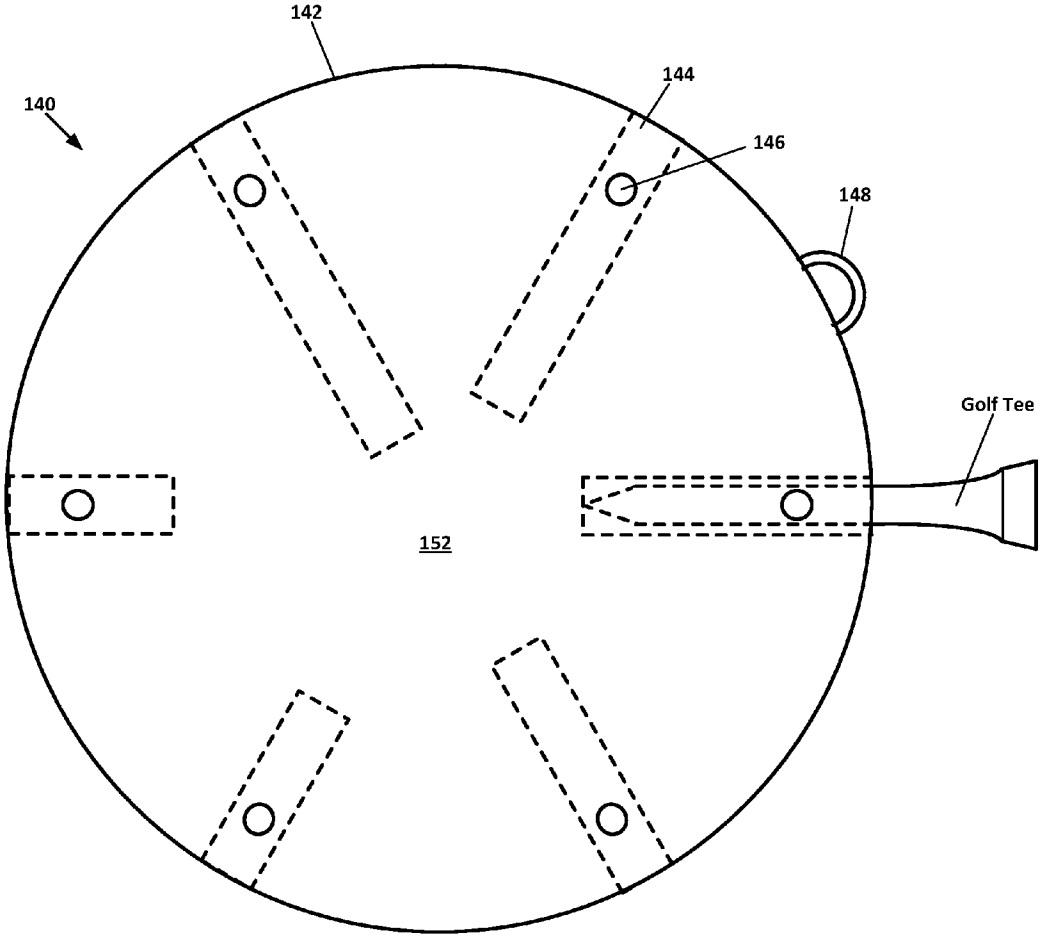

FIGS. 16A and 16B depict an eighth embodiment of a golf tee insertion depth marker tool 140. The marker tool 140 includes a housing 142 containing radially-aligned bores 144. Each bore 144 has a diameter sufficient to receive the shaft of a golf tee and extends from a cylindrical surface 150 into the housing to a depth related to a desired insertion depth of the tee. Windows 146 are provided in a planar side surface 152 of the housing 142, each aligned with a corresponding one of the bores 144. After fully inserting the tee into a bore 144, the tip of a marking pen may be inserted into the corresponding window 146 to mark the tee.

In the eighth embodiment, the cylindrical surface 150 of the housing is also referred to herein as a first surface, and the side surface 152 of the housing, also referred to herein as a second surface, is substantially perpendicular to the cylindrical surface 150. The bores 144 of this embodiment are substantially parallel to the side surface 152.

This eighth embodiment also includes a loop 148 by which the marker tool 140 may be clipped or tied to a golf bag or other structure for safekeeping.

Figure 19A:
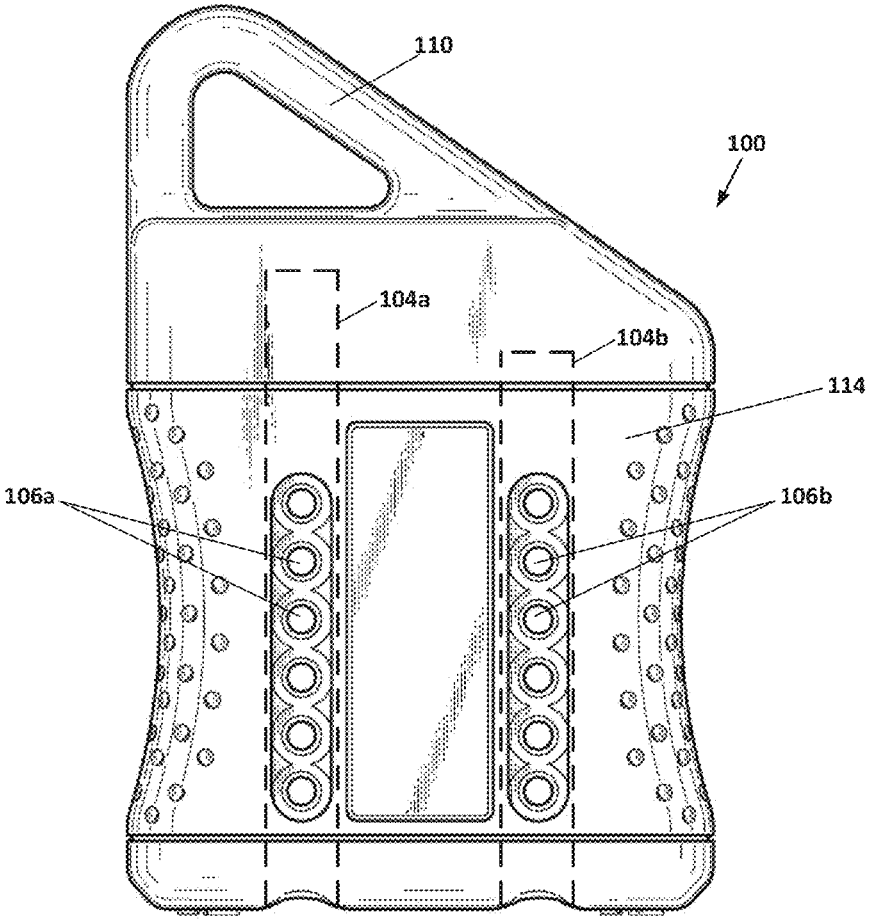
FIGS. 19A and 19B depict a golf tee insertion depth marker tool according to a ninth embodiment.
Figure 19B:
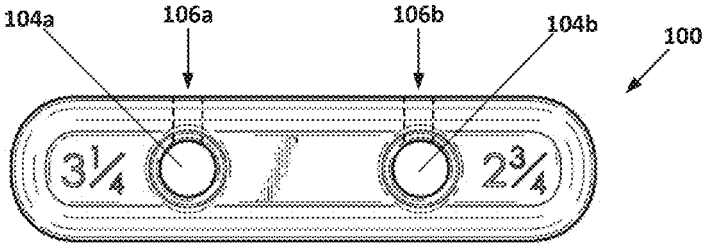

FIGS. 19A and 19B depict a ninth embodiment of a golf tee insertion depth marker tool 100. The marker tool 100 includes a housing 102 containing two linearly-aligned side-by-side bores 104*a* and 104*b*. Both bores 104*a*-104*b* have a diameter sufficient to receive the shaft of a golf tee. The bores 104*a*-104*b* extend from an upper surface 112 into the housing to depths related to desired insertion depths of the tee. In the embodiment depicted in FIG. 19A, the bore 104*a* extends deeper into the housing than does the bore 104*b*. This allows the bore 104*a* to accommodate a longer tee, such as a 3¼ inch tee, and the bore 104*b* to accommodate a shorter tee, such as a 2¾ inch tee. Two columns of spaced-apart windows 106*a* and 106*b* are provided in a planar side surface 114 of the housing 102. Each column of windows 106*a*-106*b* is aligned with a corresponding one of the bores 104*a*-104*b*. In a preferred embodiment, there are six windows 106*a*-106*b* aligned with each bore 104*a*-104*b*, and the windows 106*a*-106*b* are equally spaced apart from each other. Also in a preferred embodiment, the center-to-center spacing between adjacent windows 106*a*-106*b* in each series is about 0.22 inch, and the diameter of the windows 106*a*-106*b* is about 0.15 inch. After fully inserting the tee into a bore 104*a*-104*b*, the tip of a marking pen may be inserted into one of the windows 106*a*-106*b* to mark the tee. A process for using this embodiment of the marker tool 100 is described in more detail hereinafter.

In the ninth embodiment, the upper surface 112 of the housing is also referred to herein as a first surface, and the side surface 114 of the housing is also referred to herein as a second surface. The bores 104*a*-104*b* of this embodiment are substantially parallel to the side surface 114.

This ninth embodiment includes a loop 110 by which the marker tool 100 may be clipped or tied to a golf bag or other structure for safekeeping.

FIG. 17 depicts a preferred embodiment of a golf tee insertion depth measurement tool 210. The tool 10 preferably includes a unitary body having a base portion 212 and an elongate stem portion 214 that extends upward away from the base portion 212. In this embodiment, the base portion 12 may resemble a golf ball that has been cut in half along a horizontal line with a rounded edge 216 and a flat edge 218. The stem portion 214 preferably extends upward from the center of the rounded edge 216 to a height $H_2$. The stem portion 14 is preferably rectangular in cross section with a width $W_1$ of about 0.4 inch and a thickness $T_1$ of about 0.1 inch in preferred embodiments. The length of the stem portion 14 is different in various embodiments, but generally approximates the length of standard golf tees. The preferred length of the stem portion 14 is 2.75 inch for embodiments used with 2¾ inch tees, and 3.25 inch for embodiments used with 3¼ inch tees. In certain embodiments, the stem portion 14 is longer than the height of the club face of the selected club.

Figure 17A:
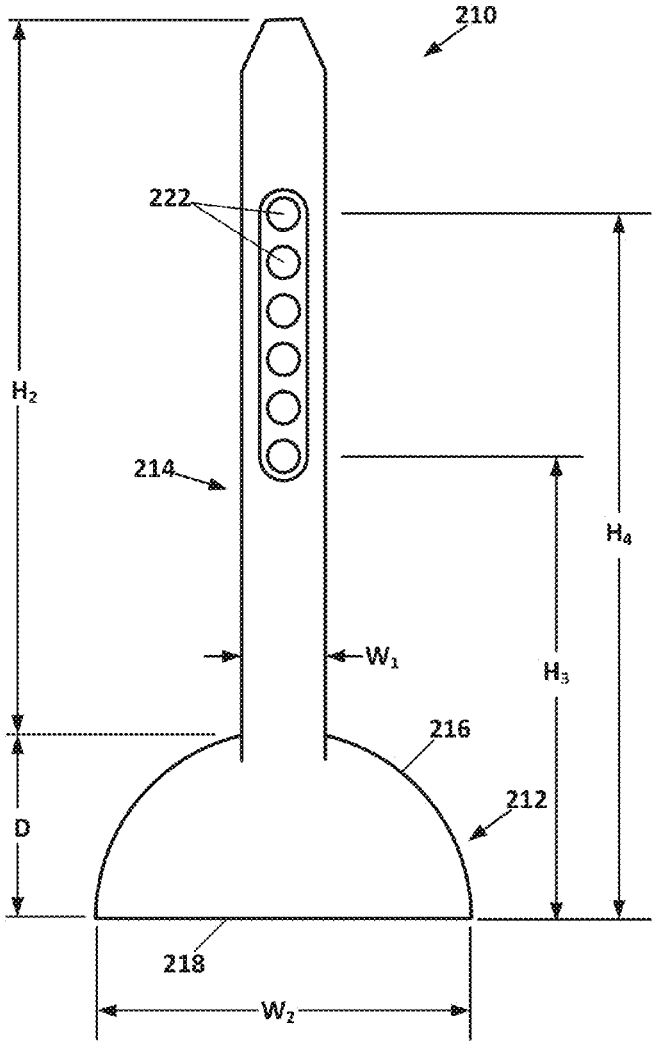
FIGS. 17A and 17B depict a golf tee insertion depth measurement tool according to an embodiment of the invention.
Figure 17B:
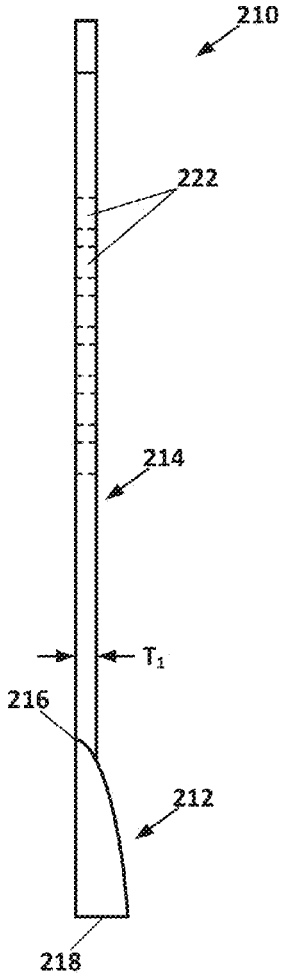

As shown in FIGS. 17A-17B, a series of indicator apertures 222 pass through the stem portion 214. These apertures 222, which are preferably equally-spaced apart, are positioned at various heights above the bottom edge 218 of the base portion 212, corresponding to various heights of the striking faces of various sizes of drivers and other clubs. The indicator aperture closest to the base portion is at a height $H_3$ above the bottom surface of the base portion, and the indicator aperture farthest from the base portion is at a height $H_4$ above the bottom surface of the base portion. The height $H_3$ is less than or equal to the height $H_1$ of the striking face of the club or driver, and the height $H_4$ is greater than or equal to the height $H_1$ of the striking face of the club or driver. In a preferred embodiment, six indicator apertures 222 are provided at a center-to-center spacing of about 0.22 inch. The diameter of the apertures 222 in a preferred embodiment is about 0.15 inch.

The base portion 212 is sized such that the distance between the top of the rounded edge 216 and the flat edge 218 is approximately the radius of a golf ball. For today's standard golf balls, that distance is approximately 0.84 inch. In a preferred embodiment, the width $W_2$ of the base portion 212 is about 1.68 inch. The base portion 212 may be formed as a generally flat plate as shown in FIGS. 17A and 17B. In other embodiments, the base portion 212 may be more three-dimensional in shape. For example, the base portion 12 may resemble a hemisphere or half of a hemisphere. An advantage of a more three-dimensional in shape is the possibility of added rigidity and stability. An advantage of having a thinner, more plate-like configuration is that the tool 210 is more compact and easier to carry and store. Additionally, placing the tool 210 in close proximity to the face of a golf club is simpler with a more plate-like base portion. As shown in the embodiment depicted in FIG. 20, the base portion 212 may optionally include grip features 220, such as ridges, dimples, notches, knobs or the like, that assist in gripping and handling the tool 210.

In general, the tool 210 is used to determine an optimum depth to which a tee should be inserted into the ground such that, once a ball is placed on the tee, the ball is located at the ideal vertical height above the ground. With reference to FIGS. 17A-17B and 18A-18B, the height $H_1$ represents the distance from the ground surface to the top of the striking face of the golf club when the bottom of the golf club head is resting on the ground. As explained above, the horizontal centerline of the golf ball is ideally located at the height $H_1$ from the ground surface. As such, one half the height of the golf ball (i.e., the radius of the golf ball) plus the portion of the golf tee above the ground surface should approximately equal the height $H_1$. The height $H_1$ will vary according to the type and size of club that is used.

It may be difficult to repeatedly and consistently estimate the horizontal centerline of a golf ball. To make this task more repeatable, the tool 210 is provided with a base portion 212 that approximates the radius of a standard golf ball. As shown in FIGS. 17A-17B, the distance D between the flat edge 18 and the rounded edge 16 measured orthogonally from the center of the flat edge 18 equals approximately the radius of a standard size golf ball. To properly locate the golf ball above the ground surface, the tee should be inserted into the ground until a distance L, equal to $H_1$ minus D, extends above the ground surface.

Figure 18A:
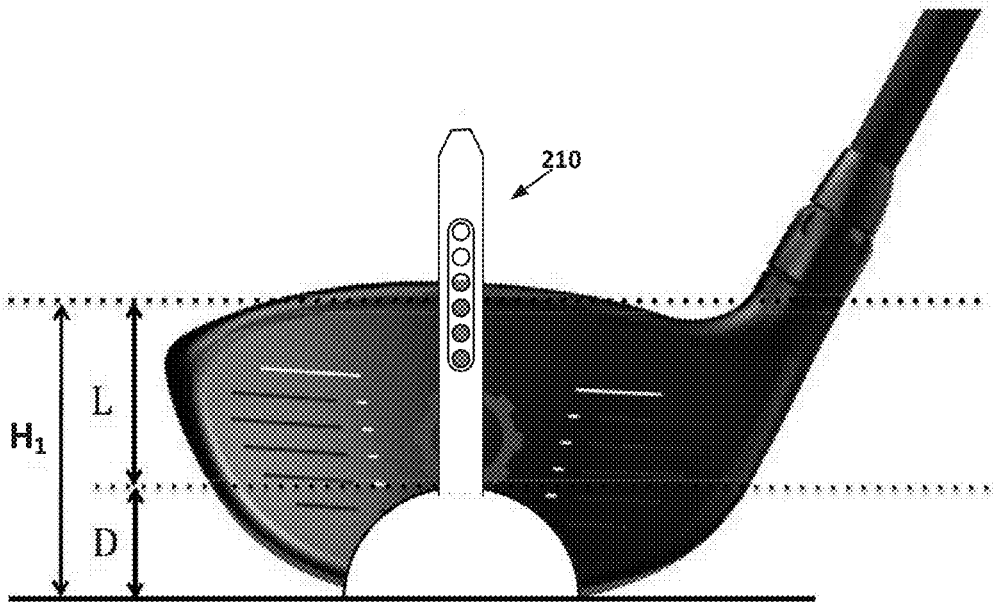
FIGS. 18A and 18B depict use of a golf tee insertion depth measurement tool to determine an optimum insertion depth according to an embodiment of the invention.
Figure 18B:
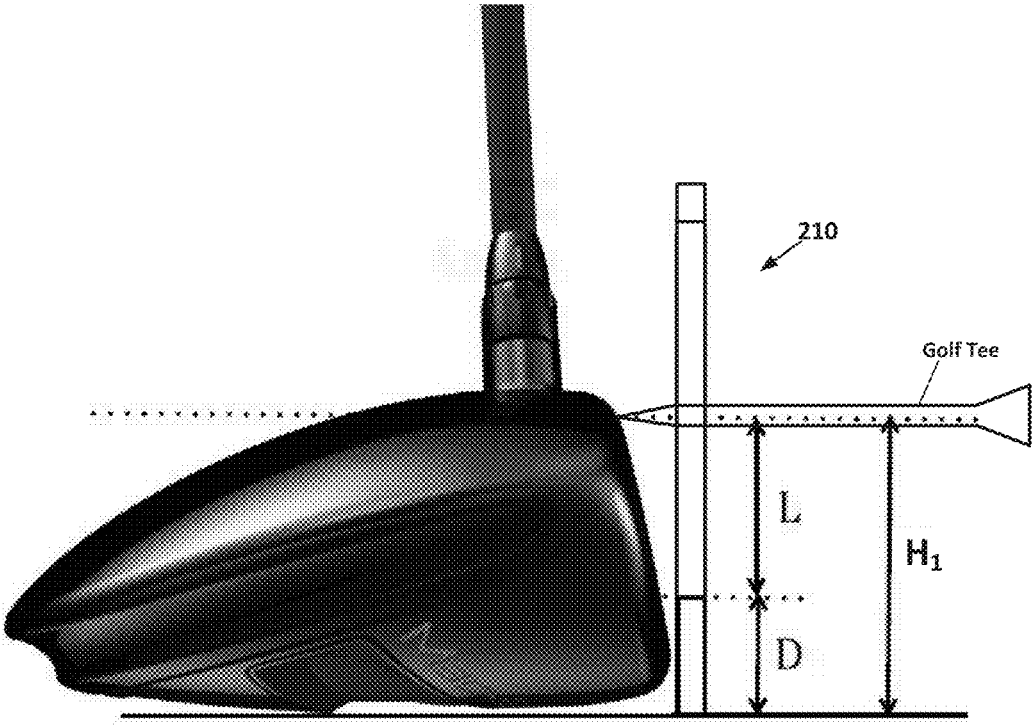

As shown in FIGS. 18A-18B, the tool 210 is first placed onto the ground surface where the tee is to be located such that the flat edge 218 of the base portion 212 rests on the ground surface. The golf club head is then placed in close approximation to the tool 210. It may be appreciated that obtaining an accurate measurement of vertical height is important to obtaining a ball located at the ideal height. An advantage of the flat edge 218 is that it ensures the stem portion 212 extends vertically and is not tilted to one side or the other, thereby ensuring that the vertical measurement taken is accurate. To ensure that the tool 210 does not lean forward or backward, some embodiments of the tool 210 may be provided with a more three-dimensional (i.e., non-flat) base portion, such as a hemispherical base portion, to ensure the tool remains vertical in the forward and backward directions as well.

With the tool 210 positioned as shown in FIGS. 18A-18B, the golfer takes note of which of the indicator apertures 222 is most closely aligned with the height of the upper edge of the striking face. For example, the golfer may look through the apertures 222 to see which one is most closely aligned. Alternatively, as shown in FIG. 18B, the shaft of a tee may be inserted horizontally through the apertures 222 to contact the striking face of the club to determine which aperture is most closely aligned with the upper edge of the striking face. If desired, the stem 214 of the tool 210 may then be marked to indicate which aperture 222 is most closely aligned with the upper edge of the striking face.

Figure 20:
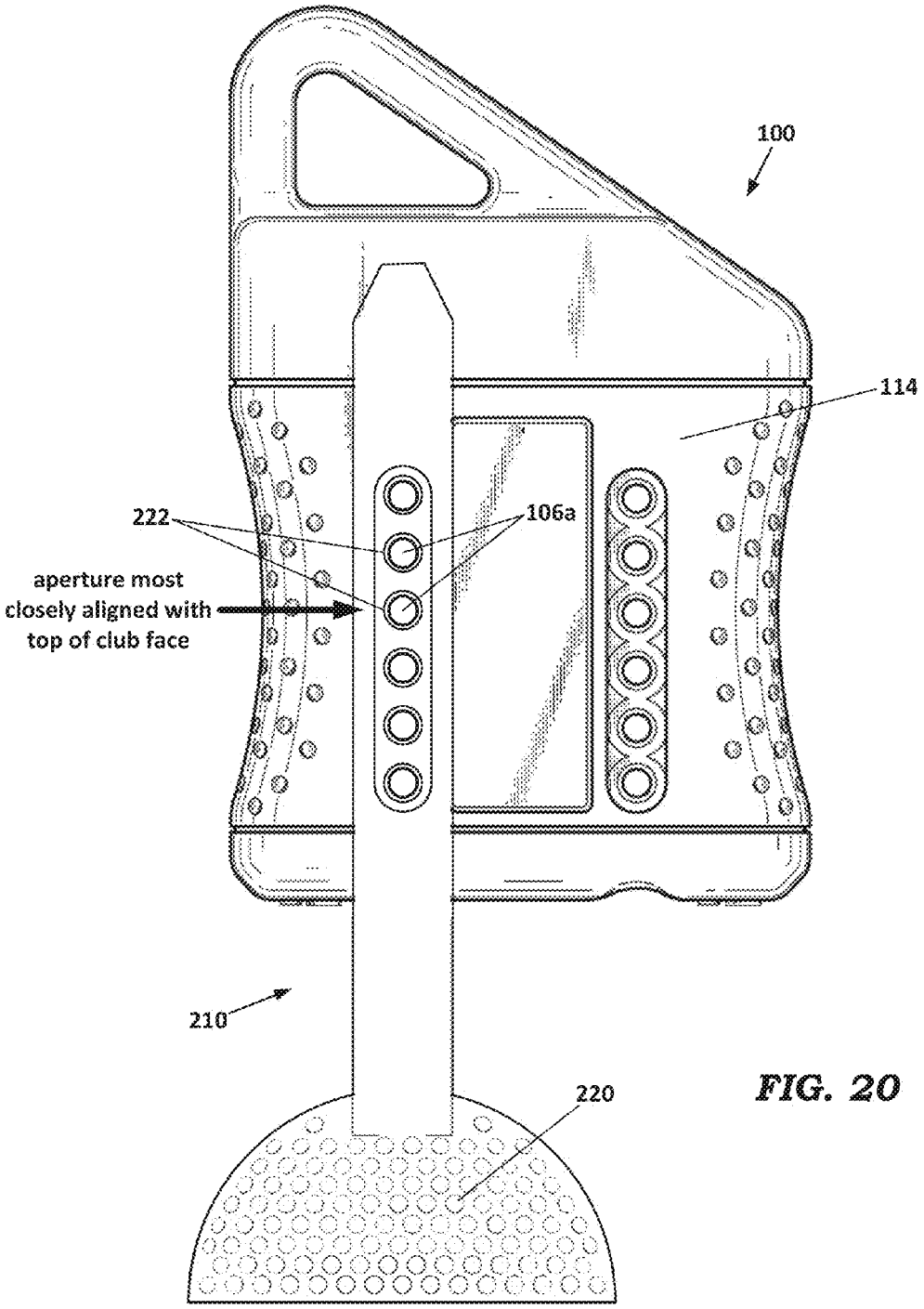
FIG. 20 depicts use of the golf tee insertion depth measurement tool of FIG. 17 in conjunction with the golf tee insertion depth marker tool of FIGS. 19A-19B according to an embodiment of the invention.

As shown in FIG. 20, the stem 214 of the measurement tool 210 is then placed against the surface 114 of the marker tool 100. In this example, the measurement tool 210 is for use with 3¼ tees. Thus, it will be aligned with the corresponding bore 104*a* and windows 106*a* that are provided for use with 3¼ tees. All of the indicator apertures 222 in the tool 210 should be aligned with all of the corresponding windows 106*a* aligned with the bore 104*a*. (If a 2¾ inch tee were to be marked, the indicator apertures 222 in a 2¾ inch measurement tool would be aligned with the windows 106*b* that are aligned with the bore 104*b*.) The golfer then takes note of which one of the windows 106*a* in the marker tool 100 is aligned with the aperture 222 of the measurement tool that was most closely aligned with the upper edge of the striking face of the club.

Figure 21A:
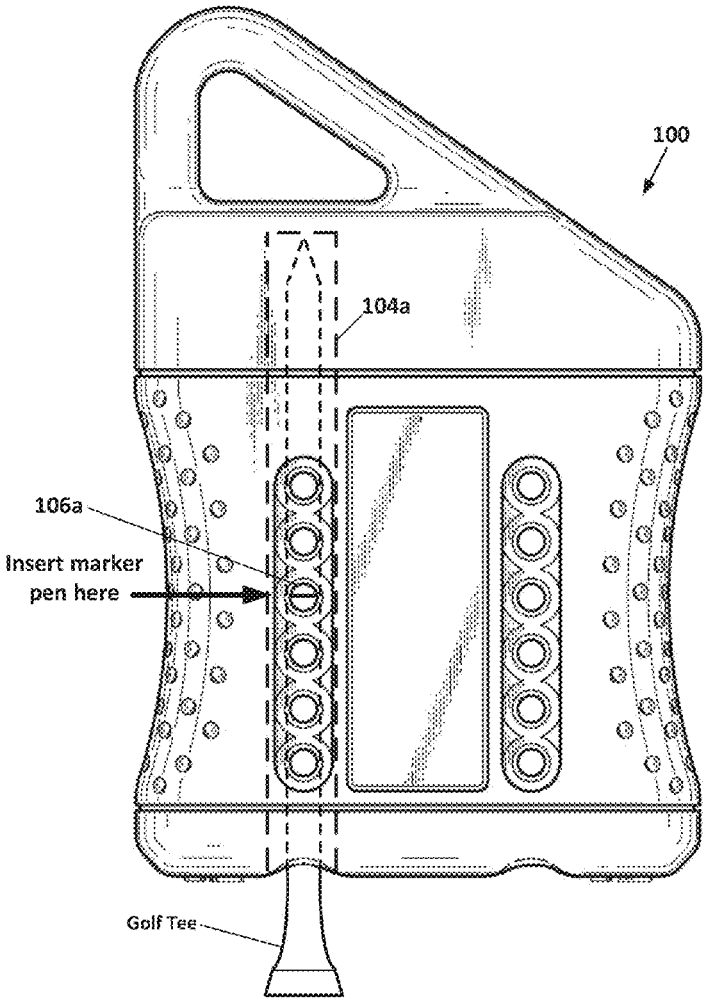
FIGS. 21A and 21B depict use of the golf tee insertion depth marker tool of FIGS. 19A-19B to mark a golf tee according to an embodiment of the invention.
Figure 21B:
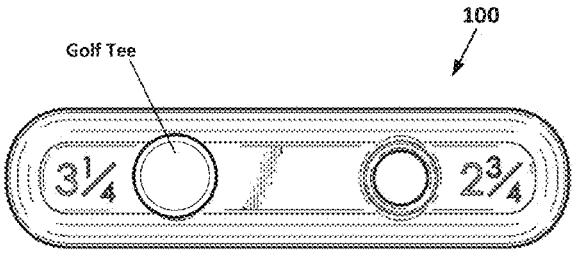

As shown in FIGS. 21A-21B, to mark the tee to indicate the optimum insertion depth, the pointed end of the tee is fully inserted into the appropriate bore 104*a* of the marker tool 100, and the tip of a marking pen is inserted into the window 106*a* noted in the previous step.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A golf tee insertion depth marking device for marking a shaft of a golf tee to indicate a desired insertion depth, the device comprising:

a housing having at least a first surface and a second surface;

a first bore extending from the first surface into the housing, the first bore having a diameter sufficient to receive the shaft of the golf tee when the shaft is inserted therein;

a plurality of first windows disposed in the second surface of the housing, the first windows providing openings into the first bore at various distances from the first surface, each first window of sufficient size to receive a tip portion of a marking pen inserted therein, whereby the tip portion of the marking pen may make contact with and mark the shaft of the golf tee inserted into the first bore;

a second bore extending from the first surface into the housing, the second bore having a diameter sufficient to receive the shaft of the golf tee when the shaft is inserted therein; and a plurality of second windows disposed in the second surface of the housing, the second windows providing openings into the second bore at various distances from the first surface, each second window of sufficient size to receive a tip portion of a marking pen inserted therein, whereby the tip portion of the marking pen may make contact with and mark the shaft of the golf tee inserted into the second bore.

2. The golf tee insertion depth marking device of claim 1 wherein the first surface includes a planar portion, the second surface includes a planar portion, and the planar portion of the first surface is substantially perpendicular to the planar portion of the second surface.

3. The golf tee insertion depth marking device of claim 1 wherein the first bore and the second bore are substantially parallel to each other and substantially parallel to the second surface.

4. The golf tee insertion depth marking device of claim 1 wherein the first bore extends into the housing to a first depth and the second bore extends in to the housing to a second depth, and the first depth is not equivalent to the second depth.

5. The golf tee insertion depth marking device of claim 1 wherein all of the plurality of first windows are equally spaced apart from each other and are aligned with the first bore.

6. The golf tee insertion depth marking device of claim 1 wherein all of the plurality of second windows are equally spaced apart from each other and are aligned with the second bore.

7. A golf tee insertion depth measurement tool for providing a gauge to facilitate marking a shaft of a golf tee to indicate a desired insertion depth that will provide an optimum height for a golf ball placed on the tee, which ball is to be struck by a club face having a height $H_1$, the tool comprising:

a base portion having:

an upper edge; and a bottom surface that is spaced from the upper edge by a distance D; and an elongate stem portion connected to the base portion and extending upwardly from the upper edge of the base portion, the stem portion having a plurality of spaced-apart apertures extending through the stem portion, the stem portion extending to a height $H_2$ above the upper edge of the base portion.

8. The golf tee insertion depth measurement tool of claim 7 wherein the height $H_2$ of the stem portion is greater than the height $H_1$ of the club face.

9. The golf tee insertion depth measurement tool of claim 7 wherein the height $H_2$ of the stem portion ranges from approximately 2¾ inches to approximately 4 inches.

10. The golf tee insertion depth measurement tool of claim 7 wherein the distance D is substantially equivalent to the radius of the golf ball.

11. The golf tee insertion depth measurement tool of claim 7 wherein the distance D is approximately 0.84 inch.

12. The golf tee insertion depth measurement tool of claim 7 wherein the elongate stem portion is disposed perpendicular to the bottom surface of the base portion.

13. The golf tee insertion depth measurement tool of claim 7 wherein the plurality of apertures are equally spaced apart from each other.

14. The golf tee insertion depth measurement tool of claim 7 wherein at least one of the plurality of apertures is disposed at a height above the bottom surface of the base portion that is substantially equivalent to the height $H_1$ of the club face.

15. The golf tee insertion depth measurement tool of claim 7 wherein one of the plurality of apertures closest to the base portion is at a height $H_3$ above the bottom surface of the base portion, one of the plurality of apertures farthest from the base portion is at a height $H_4$ above the bottom surface of the base portion, the height $H_3$ is less than or equal to the height $H_1$ of the club face, and the height $H_4$ is greater than or equal to the height $H_1$ of the club face.

16. The golf tee insertion depth measurement tool of claim 7 wherein each of the plurality of apertures extends completely through the stem portion.

17. The golf tee insertion depth measurement tool of claim 7 wherein the upper edge of the base portion forms at least a portion of a semicircle.

18. The golf tee insertion depth measurement tool of claim 7 wherein the base portion is shaped as a hemisphere.

19. The golf tee insertion depth measurement tool of claim 7 wherein the base portion is shaped as a portion of a hemisphere.

20. The golf tee insertion depth measurement tool of claim 7 wherein an exterior surface of the base portion includes a plurality of grip features.

21. A golf tee insertion depth marking apparatus for marking a shaft of a golf tee to indicate a desired insertion depth that will provide an optimum height for a golf ball placed on the tee, which ball is to be struck by a club face having a height $H_1$, the apparatus comprising:

a marker tool comprising:

a housing having at least a first surface and a second surface;

a first bore extending from the first surface into the housing, the first bore having a diameter sufficient to receive the shaft of the golf tee when the shaft is inserted therein;

a plurality of first windows disposed in the second surface of the housing, each of the first windows providing an opening into the first bore, each first window of sufficient size to receive a tip portion of a marking pen inserted therein, whereby the tip portion of the marking pen may make contact with and mark the shaft of the golf tee inserted into the first bore;

a second bore extending from the first surface into the housing, the second bore having a diameter sufficient to receive the shaft of the golf tee when the shaft is inserted therein; and a plurality of second windows disposed in the second surface of the housing, each of the second windows providing an opening into the second bore, each second window of sufficient size to receive a tip portion of a marking pen inserted therein, whereby the tip portion of the marking pen may make contact with and mark the shaft of the golf tee inserted into the second bore; and a measurement tool comprising:

a base portion having:

an upper edge; and a bottom surface that is spaced from the upper edge by a distance D; and an elongate stem portion connected to the base portion and extending upwardly from the upper edge of the base portion, the stem portion having a plurality of spaced-apart apertures extending through the stem portion, the stem portion extending to a height $H_2$ above the upper edge of the base portion.

22. The golf tee insertion depth marking apparatus of claim 21 wherein the marker tool has a first number of first windows and a second number of second windows, and the measurement tool has a third number of apertures, and wherein the first number, the second number and the third number are equivalent.

23. The golf tee insertion depth marking apparatus of claim 21 wherein the spacing between the first windows is equivalent to the spacing between the second windows.

24. The golf tee insertion depth marking apparatus of claim 21 wherein the spacing between the first windows in the marker tool and the spacing between the second windows in the marker tool are equivalent to the spacing between the apertures in the measurement tool.

25. A method of using a measurement tool and a marking tool to mark a shaft of a golf tee to indicate a desired insertion depth that will provide an optimum height above the ground for a golf ball placed on the golf tee, which ball is to be struck by a golf club head having a face, wherein the measurement tool comprises a base portion and an elongate stem portion extending from the base portion, wherein the stem portion has a plurality of spaced-apart apertures, and wherein the marking tool comprises a housing having a first surface, a second surface, a one bore extending from the first surface into the housing, and a plurality of windows disposed in the second surface of the housing that each provide an opening into the bore, the method comprising the steps of:

(a) placing the base portion of the measurement tool on the ground with the stem portion extending upwardly;

(b) placing the golf club head on the ground with the face of the golf club adjacent the measurement tool;

(c) determining which one of the apertures in the stem portion of the measurement tool is closest to an upper edge of the face of the golf club;

(d) placing the measurement tool adjacent the marking tool, with the apertures of the measurement tool aligned with the windows of the marking tool;

(e) determining which one of the windows of the marking tool is aligned with the aperture determined in step (c);

(f) inserting the golf tee into the bore of the marking tool; and (g) marking the shaft of the golf tee by inserting a tip portion of a marking pen into the window determined in step (e) and contacting the tip portion of the marking pen against the shaft of the golf tee.

* * * * *